US011120743B2

(12) United States Patent
Xu

(10) Patent No.: US 11,120,743 B2
(45) Date of Patent: Sep. 14, 2021

(54) PIXEL DRIVING CIRCUIT AND DISPLAY DEVICE

(71) Applicant: SeeYA Optronics Co., Ltd., Shanghai (CN)

(72) Inventor: Wenwei Xu, Shanghai (CN)

(73) Assignee: SEEYA OPTRONICS CO., LTD., Shanghai (CN)

( * ) Notice: Subject to any disclaimer, the term of this patent is extended or adjusted under 35 U.S.C. 154(b) by 0 days.

(21) Appl. No.: 17/004,619

(22) Filed: Aug. 27, 2020

(65) Prior Publication Data

US 2021/0193042 A1 Jun. 24, 2021

(30) Foreign Application Priority Data

Dec. 19, 2019 (CN) ..... 201911319097.1

(51) Int. Cl.
*G09G 3/3258* (2016.01)
*G09G 3/3233* (2016.01)

(52) U.S. Cl.
CPC ..... *G09G 3/3258* (2013.01); *G09G 3/3233* (2013.01); *G09G 2300/0426* (2013.01); *G09G 2310/08* (2013.01); *G09G 2320/0233* (2013.01)

(58) Field of Classification Search
None
See application file for complete search history.

(56) References Cited

U.S. PATENT DOCUMENTS 8,976,091 B2 * 3/2015 Tseng ..... G09G 3/3233 345/82
10,997,920 B2 * 5/2021 Shi ..... G09G 3/3258
2020/0211464 A1 * 7/2020 Yue ..... G09G 3/3225

FOREIGN PATENT DOCUMENTS

| | | | |
|---|---|---|---|
| CN | 106782292 | A | 5/2017 |
| CN | 107393476 | A | 11/2017 |
| CN | 108877669 | A | 11/2018 |
| CN | 110036435 | A | 7/2019 |
| GN | 103035174 | A | 4/2013 |
| GN | 103413520 | A | 11/2013 |
| GN | 104900186 | A | 9/2015 |
| WO | 2017177500 | A1 | 10/2017 |

OTHER PUBLICATIONS

First Office Action for CN Application No. 2019113190971 dated Nov. 27, 2020.

* cited by examiner

*Primary Examiner* — Duane N Taylor, Jr.
(74) *Attorney, Agent, or Firm* — Carlson, Gaskey & Olds

(57) ABSTRACT

A pixel driving circuit includes a driving transistor connected in series between a first power supply voltage terminal and a second power supply voltage terminal. The driving transistor has a control terminal electrically connected to a first node, a first terminal electrically connected to a second node, and a second terminal electrically connected to a third node. The second node is located between the first power supply voltage terminal and the driving transistor. The third node is located between the second power supply voltage terminal and the driving transistor. A light-emitting element is connected in series between the third node and the second power supply voltage terminal. A voltage maintaining module is configured to maintain a voltage of the third node unchanged.

10 Claims, 2 Drawing Sheets

PIXEL DRIVING CIRCUIT AND DISPLAY DEVICE

CROSS-REFERENCE TO RELATED APPLICATIONS

The present application claims priority to Chinese Patent Application No. 201911319097.1, filed on Dec. 19, 2019, which is incorporated herein by reference in its entirety.

TECHNICAL FIELD

The present disclosure relates to the field of display technologies, and in particular, to a pixel driving circuit and a display device.

BACKGROUND

Organic light-emitting display devices are also named organic light-emitting diode (OLED) display devices and have advantages of lightness, thinness, and large viewing angles compared with liquid crystal display devices. Pixel driving circuits are provided in the organic light-emitting display panel of the display device, and the pixel driving circuit is used to control light-emitting of light-emitting elements in the display panel to realize image display.

However, the current pixel driving circuit may cause a problem of uneven brightness of the display panel.

SUMMARY

In one aspect, an embodiment of the present disclosure provides a pixel driving circuit including: a driving transistor connected in series between a first power supply voltage terminal and a second power supply voltage terminal and having a control terminal electrically connected to a first node, a first terminal electrically connected to a second node, and a second terminal electrically connected to a third node. The second node is located between the first power supply voltage terminal and the driving transistor. The third node is located between the second power supply voltage terminal and the driving transistor. A light-emitting element is connected in series between the third node and the second power supply voltage terminal. A voltage maintaining module is configured to maintain a voltage of the third node unchanged.

In an embodiment, the voltage maintaining module includes: a first transistor connected in series between the third node and the light-emitting element, wherein the first transistor is a P-type transistor and has a source electrode electrically connected to the third node and a drain electrode electrically connected to a fourth node, and the fourth node is electrically connected to the light-emitting element; a first current unit electrically connected to the third node and configured to generate a first current flowing to the third node; and a second current unit electrically connected to the fourth node and configured to enable a second current to flow out of the fourth node, wherein a current value of the first current is equal to a current value of the second current.

In another aspect, an embodiment of the present disclosure provides a pixel driving circuit including: a driving transistor connected in series between a first power supply voltage terminal and a second power supply voltage terminal and having a control terminal electrically connected to a first node, a first terminal electrically connected to a second node, and a second terminal electrically connected to a third node. The second node is located between the first power supply voltage terminal and the driving transistor. The third node is located between the second power supply voltage terminal and the driving transistor. A light-emitting device is connected in series between the third node and the second power supply voltage terminal. A first transistor is connected in series between the third node and the light-emitting element. The first transistor is a P-type transistor and has a source electrode electrically connected to the third node and a drain electrode electrically connected to a fourth node that is electrically connected to the light-emitting element. A second transistor is a P-type transistor and has a source electrode electrically connected to a first fixed potential terminal and a drain electrode electrically connected to the third node. A third transistor is an N-type transistor and has a source electrode electrically connected to a second fixed potential terminal and a drain electrode electrically connected to the fourth node. An operating timing sequence of the pixel driving circuit includes a light-emitting phase in which each of the second transistor and the third transistor operates in a saturation region.

In another aspect, an embodiment of the present disclosure provides a display device including the pixel driving circuit as described above.

The pixel driving circuit and the display device in the embodiments of the present disclosure can maintain the voltage of the node between the driving transistor and the light-emitting element unchanged during the light-emitting phase so that the driving current generated by the driving transistor will not be affected by a change in the voltage across the two ends of the light-emitting element, thereby mitigating or eliminating the problem of uneven display due to the change in the voltage across the two ends of the light-emitting element.

BRIEF DESCRIPTION OF DRAWINGS

In order to more clearly illustrate the technical solutions in the embodiments of the present disclosure or the related art, the accompanying drawings used in the embodiments or the related art are briefly described below. It should be noted that the drawings described below are merely some exemplary embodiments of the present disclosure. Based on these drawings, those of ordinary skill in the art can obtain other drawings without any creative effort.

DESCRIPTION OF EMBODIMENTS

To make objectives, technical solutions, and advantages of the embodiments of the present disclosure clearer, the technical solutions in the embodiments of the present disclosure will be described clearly and completely in conjunction with the drawings in the embodiments of the present disclosure. It should be noted that the embodiments described are a part of the embodiments of the present disclosure, but not all of the embodiments. Based on the embodiments of the present disclosure, all other embodiments obtained by those of ordinary skill in the art without making creative efforts fall within the protection scope of the present disclosure.

The terms used in the embodiments of the present disclosure are merely for the purpose of describing particular embodiments and not intended to limit the present disclosure. Unless the context clearly indicates otherwise, the singular form expressions "a", "an", "the" and "said" used in the embodiments and appended claims of the present disclosure are also intended to represent plural forms.

Figure 1:
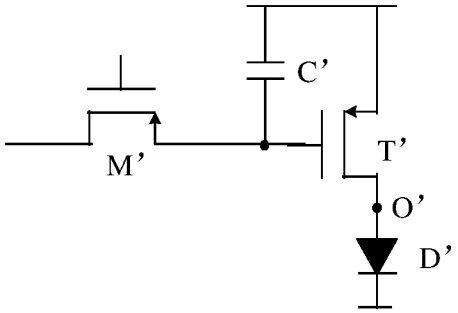
FIG. 1 (Prior Art)
FIG. 1 is an equivalent circuit diagram of a pixel driving circuit in the related art.

In order to better illustrate the technical effects of the embodiments of the present disclosure, the deficiencies of the related art will be described first before describing the embodiments of the present disclosure. FIG. 1 is an equivalent circuit diagram of a pixel driving circuit in the related art. As shown in FIG. 1, a current pixel driving circuit includes a transistor M', a driving transistor T', a capacitor C' and a light-emitting element D', and a connection node between the driving transistor T' and the light-emitting element D' is O'. The inventor found that a voltage between an anode and a cathode of the light-emitting element D' may change due to problems such as aging, which then causes a potential at the node O' to change, so as to cause a driving current generated by the driving transistor T' to change. The driving current can affect a change of light-emitting brightness of the light-emitting element D', which further causes uneven brightness of the display panel.

Figure 2:
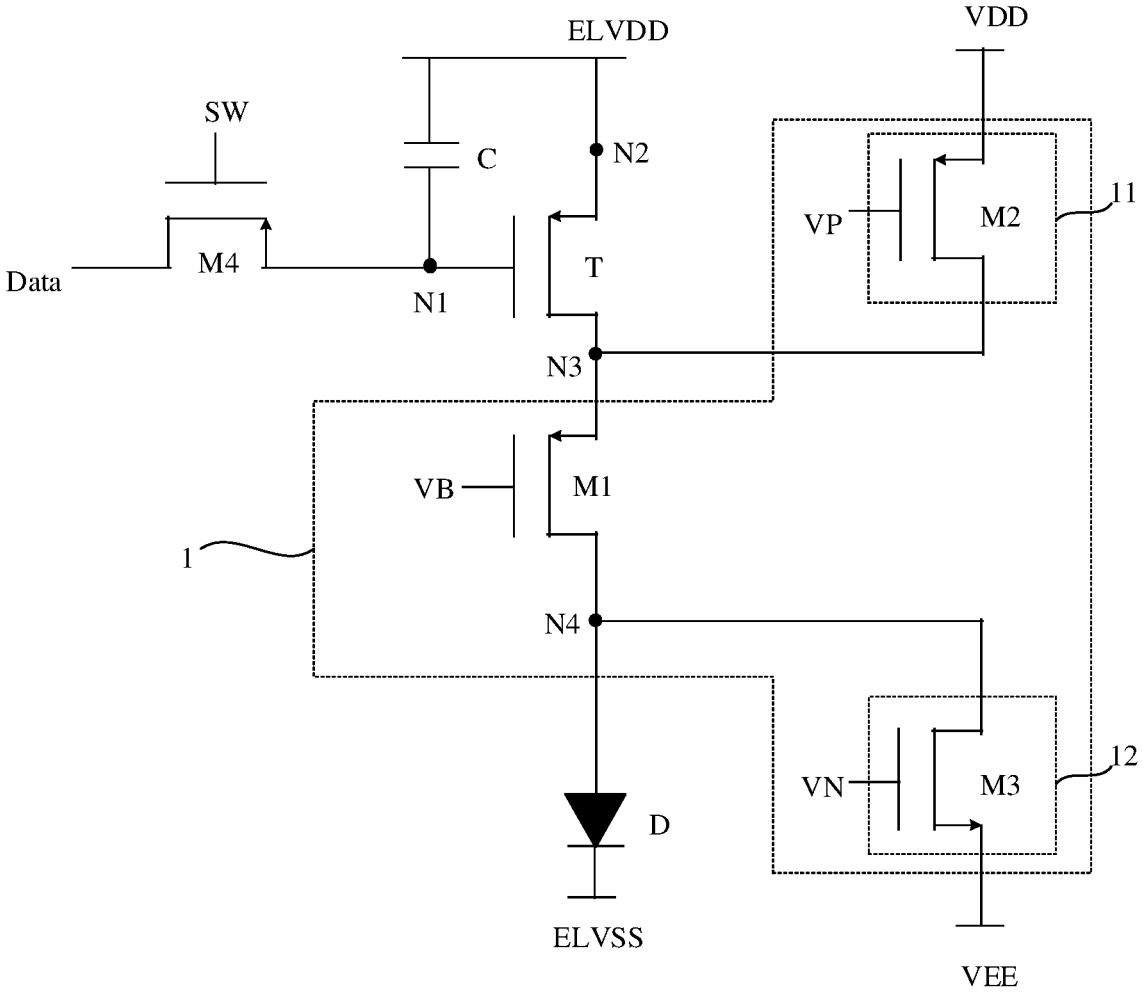
FIG. 2 is an equivalent circuit diagram of a pixel driving circuit in an embodiment of the present disclosure.

FIG. 2 is an equivalent circuit diagram of a pixel driving circuit in an embodiment of the present disclosure. As shown in FIG. 2, the embodiment of the present disclosure provides a pixel driving circuit including: a driving transistor T connected in series between a first power supply voltage terminal ELVDD and a second power supply voltage terminal ELVSS. The driving transistor T has a control terminal electrically connected to a first node N1, a first terminal electrically connected to a second node N2, and a second terminal electrically connected to the third node N3. The second node N2 is located between the first power supply voltage terminal ELVDD and the driving transistor T, and the third node N3 is located between the second power supply voltage terminal ELVSS and the driving transistor T. The pixel driving circuit further includes: a light-emitting element D connected in series between the third node N3 and the second power supply voltage terminal ELVSS; and a voltage maintaining module 1 configured to maintain a voltage of the third node N3 unchanged.

By setting that the voltage maintaining module 1 is configured to maintain the voltage of the third node N3 unchanged, even if the voltage between the anode and the cathode, of the light-emitting element D has changes due to aging or other reasons, the voltage of the third node N3 is not affected. Therefore, a change of the driving current of the driving transistor T is controlled only by a change of the voltage of the first node N1, and the driving current generated by the driving transistor T will not be affected by the change in the voltage across the two ends of the light-emitting element D.

In the embodiment of the present disclosure, by providing the voltage maintaining module in the pixel driving circuit to maintain the voltage of the node between the driving transistor and the light-emitting element unchanged, the driving current generated by the driving transistor is not be affected by the change of the voltage between the two ends of the light-emitting element, thereby mitigating or eliminating the problem of uneven display due to the change in the voltage across the two ends of the light-emitting element.

In an embodiment, the voltage maintaining module 1 includes: a first transistor M1 connected in series between the third node N3 and the light-emitting element D. The first transistor M1 is a P-type transistor and has a source electrode electrically connected to the third node N3 and a drain electrode electrically connected to a fourth node N4, and the fourth node N4 is electrically connected to the light-emitting element D. The voltage maintaining module 1 further includes: a first current unit 11 electrically connected to the third node N3, and a second current unit 12 electrically connected to the fourth node N4. The first current unit 11 is configured to generate a first current flowing to the third node N3, the second current unit 12 is configured to enable a second current to flow out of the fourth node N4, and a current value of the first current is equal to a current value of the second current.

In the light-emitting process of the light-emitting element D, the driving transistor T operates in a sub-threshold region, and generates a driving current that has a relatively small value in a level of pA to nA, the first current unit 11 and the second current unit 12 are controlled to allow the first current and the second current to have relatively large current values in a level of μA. For example, it is assumed that the value of the driving current generated by the driving transistor T is $I_1$, and the current value of the first current is $I_2$, then the value of the current flowing through the first transistor M1 is $I_3=I_1+I_2$. The voltage of the control terminal VB of the first transistor M1 is controlled to be unchanged, the first transistor M1 is controlled to operate in a saturation region. Since the first transistor M1 is a P-type transistor, then according to a formula of the current of the saturation region, $$I_3 = I_1 + I_2 = \mu_1 C_{ox1}\left(\frac{W_1}{L_1}\right)(V_B - V_3 - V_{th1})^2,$$

where $\mu_1$ is a carrier mobility of the first transistor M1, $C_{ox1}$ is a capacitance of a gate oxide layer of the first transistor M1, $W_1$ is a channel width of the first transistor M1, $L_1$ is a channel length of the first transistor M1, $V_B$ is a voltage value of the control terminal of the first transistor M1, $V_3$ is a voltage value of the third node N3, and $V_{th1}$ is a threshold voltage of the first transistor M1. Since $I_2$ is much larger than $I_1$, and the first transistor M1 operates in the saturation region, it can be understood that $V_B-V_3$ is only related to $I_2$, and $V_3$ can be maintained unchanged simply by controlling $I_2$ and $V_B$ unchanged. Moreover, the currents flowing through the first current unit 11 and the second current unit 12 do not enter the light-emitting element D, so the light-emitting element D only receives the driving current generated by the driving transistor T, that is, the light-emitting element D will not be affected by the first current unit 11 and the second current unit 12.

In an embodiment, the first current unit 11 includes a second transistor M2, and the second transistor M2 is a P-type transistor and has a source electrode electrically connected to a first fixed potential terminal VDD and a drain electrode electrically connected to the third node N3; and the second current unit 12 includes a third transistor M3, and the third transistor M3 is an N-type transistor and has a source electrode electrically connected to a second fixed potential terminal VEE and a drain electrode electrically connected to the fourth node N4.

The second transistor M2 can be controlled to operate in the saturation region by controlling the voltage value $V_P$ of the control terminal VP of the second transistor M2 to satisfy $|V_P-V_{DD}|>|V_{th2}|$, $|V_P-V_{DD}|-|V_{th2}|<V_{DD}-V_3$, that is, $V_3+V_{th2}<V_P<V_{DD}+V_{th2}$, $$I_2 = \mu_2 C_{ox2}\left(\frac{W_2}{L_2}\right)(V_P - V_{DD} - V_{th2})^2,$$

where $\mu_2$ is a carrier mobility of the second transistor M2, $C_{ox2}$ is a capacitance of a gate oxide layer of the second transistor M2, $W_2$ is a channel width of the second transistor M2, $L_2$ is a channel length of the second transistor M2, $V_P$ is a voltage value of the control terminal of the second transistor M2, $V_{DD}$ is a voltage value of the first fixed potential terminal VDD, and $V_{th2}$ is a threshold voltage of the second transistor M2. Therefore, the current flowing through the second transistor M2 can be maintained unchanged simply by controlling $V_P$ unchanged. The third transistor M3 can be controlled to operate in the saturation region by controlling the voltage value $V_N$ of the control terminal VN of the third transistor M3 to satisfy $|V_N-VEE|>|V_{th3}|$, $|V_N-V_{EE}|-|V_{th3}|<V_4-V_{EE}$, that is, $V_{EE}+V_{th3}<V_N<V4+V_{th3}$, $$I_2 = \mu_3 C_{ox3}\left(\frac{W_3}{L_3}\right)(V_N - V_{EE} - V_{th3})^2,$$

where $\mu_3$ is a carrier mobility of the third transistor M3, $C_{ox3}$ is a capacitance of a gate oxide layer of the third transistor M3, $W_3$ is a channel width of the third transistor M3, $L_3$ is a channel length of the third transistor M3, $V_N$ is a voltage value of the control terminal of the third transistor M3, $V_{EE}$ is a voltage value of the second fixed potential terminal VEE, $V_{th3}$ is a threshold voltage of the third transistor M3. Therefore. the current value flowing through the third transistor M3 can be maintained unchanged simply by controlling $V_N$ unchanged.

In an embodiment, the first fixed potential terminal VDD is electrically connected to the first power supply voltage terminal ELVDD, and the second fixed potential terminal VEE is electrically connected to the second power supply voltage terminal ELVSS. In this way, the number of wires in the display panel can be reduced, to improve space utilization and reduce complexity of a circuit layout.

In an embodiment, the above-described pixel driving circuit further includes: a fourth transistor M4 which has a first terminal electrically connected to a data signal terminal Data and a second terminal electrically connected to the first node N1; a capacitor C having one terminal electrically connected to the first node N1 and another terminal electrically connected to a fixed potential, for example, electrically connected to the first power supply voltage terminal ELVDD.

When a control terminal SW of the fourth transistor M4 is provide with a turn-on level, the fourth transistor M4 is turned on, a voltage on the data signal terminal Data is transmitted to the first node N1, the voltage at the first node N1 is maintained under an effect of the capacitor C, and the driving transistor T generates a corresponding driving current under an effect of the voltage at the first node N1. For example, a plurality of pixel driving circuits distributed in an array is provided in the display panel; each column of pixel driving circuits of the plurality of pixel driving circuits corresponds to one data signal line, the data signal line is electrically connected to data signal terminals Data of the pixel driving circuits in the corresponding column, and the data signal line is configured to transmit a data voltage provided by a driving chip to the corresponding pixel driving circuits; and each row of pixel driving circuits of the plurality of pixel driving circuits corresponds to one scanning line, and the plurality of pixel driving circuits is scanned row by row under controlling of the scanning lines, in order to transmit the voltage on the data signal line to the corresponding pixel driving circuits row by row, to control the corresponding light-emitting elements D to emit light.

In an embodiment, the driving transistor T is a P-type transistor and operates in a sub-threshold state.

When the driving transistor T operates in the sub-threshold state, the driving current is not only related to a gate-source voltage, but also related to a drain voltage, i.e., the voltage at the third node N3. Therefore, by applying the pixel driving circuit provided by the embodiment of the present disclosure, the voltage of the third node N3 can be maintained unchanged. Thus, the change of the driving current of the driving transistor T is controlled only by the change of the voltage of the first node N1, and the driving current generated by the driving transistor T will not be affected by the change in the voltage across the two ends of the light-emitting element D.

As shown in FIG. 2, an embodiment of the present disclosure further provides a pixel driving circuit including: a driving transistor T connected in series between the first power supply voltage terminal ELVDD and the second power supply voltage terminal ELVSS. The driving transistor T has a control terminal electrically connected to the first node N1, a first terminal electrically connected to the second node N2, and a second terminal electrically connected to the third node N3. The second node N2 is located between the first power supply voltage terminal ELVDD and the driving transistor T, and the third node N3 is located between the second power supply voltage terminal ELVSS and the driving transistor T. The pixel driving circuit further includes: a light-emitting element D connected in series between the third node N3 and the second power supply voltage terminal ELVSS; a first transistor M1; a second transistor M2; and a third transistor M3. The first transistor M1 is connected in series between the third node N3 and the light-emitting element D, the first transistor M1 is a P-type transistor and has a source electrode electrically connected to the third node N3 and a drain electrode electrically connected to the fourth node N4, and the fourth node N4 is electrically connected to the light-emitting element D. The second transistor M2 is a P-type transistor and has a source electrode electrically connected to the first fixed potential terminal VDD and a drain electrode electrically connected to the third node N3. The third transistor M3 is an N-type transistor and has a source electrode electrically connected to the second fixed potential terminal VEE and a drain electrode electrically connected to the fourth node N4. An operating timing sequence of the pixel driving circuit includes a light-emitting phase, in which each of the second transistor M2 and the third transistor M3 operates in a saturation region.

The light-emitting phase refers to a phase in which the light-emitting element D emits light under the control of the pixel driving circuit. At this time, the second transistor M2 is controlled to operate in the saturation region, $V_3+V_{th2}<V_P<V_{DD}+V_{th2}$ is satisfied, a voltage value of the control terminal VP of the second transistor M2 and the voltage value of the first fixed potential terminal VDD can be set according to the above conditions. The first current flows through the second transistor M2 and has a current value of $I_2$, and then according to a formula of the current in the saturation region, $$I_2 = \mu_2 C_{ox2}\left(\frac{W_2}{L_2}\right)(V_P - V_{DD} - V_{th2})^2.$$

Therefore, the current value flowing through the second transistor M2 can be maintained unchanged simply by controlling $V_P$ unchanged. Also, at this time, the third transistor M3 operates in the saturation region, $V_{EE}+V_{th3}<V_N<V4+V_{th3}$ is satisfied, and a voltage value of the control terminal $V_N$ of the third transistor M3 and the voltage value of the second fixed potential terminal VEE can be set according to the above conditions. The second current flows through the third transistor M3 and also has a current value of $I_2$, and then according to a formula of the current in the saturation region, $$I_2 = \mu_3 C_{ox3}\left(\frac{W_3}{L_3}\right)(V_N - V_{EE} - V_{th3})^2.$$

Therefore, the current value flowing through the third transistor M3 can be maintained unchanged simply by controlling $V_N$ unchanged, and the current flowing through the second transistor M2 and the current flowing through the third transistor M3 can be controlled to be equal simply by the relationship between the above parameters. The driving transistor T operates in the sub-threshold region, the generated driving current value is relatively small, which is in a level of pA to nA. The first current unit 11 and the second current unit 12 are controlled so that the first current and the second current have relatively large current values, which are in a level of μA. For example, assuming that the value of the driving current generated by the driving transistor T is $I_1$, the value of the current flowing through the first transistor M1 is $I_3=I_1+I_2$, the voltage of the control terminal VB of the first transistor M1 is controlled to be unchanged, and the first transistor M1 is controlled to operate in the saturation region, then since the first transistor M1 is a P-type transistor, according to a formula of the current of the saturation region, $$I_3 = I_1 + I_2 = \mu_1 C_{ox1}\left(\frac{W_1}{L_1}\right)(V_B - V_3 - V_{th1})^2,$$

$I_2$ is much larger than $I_1$, and the first transistor M1 operates in the saturation region, it can be therefore understood that $V_B-V_3$ is only related to $I_2$, and $V_3$ can be maintained unchanged simply by controlling $I_2$ and $V_B$ unchanged. Moreover, the currents flowing through the first current unit 11 and the second current unit 12 will not enter the light-emitting element D. Therefore, the light-emitting element D will only receive the driving current generated by the driving transistor T, and therefore, the light-emitting element D will not be affected by the first current unit 11 and the second current unit 12.

In the pixel driving circuit in the embodiment of the present disclosure, the voltage of the node between the driving transistor and the light-emitting element can be maintained unchanged during the light-emitting phase, so that the driving current generated by the driving transistor will not be affected by the change of the voltage across the two ends of the light-emitting element, thereby mitigating or eliminating the problem of uneven display due to the change in the voltage across the two ends of the light-emitting element.

In an embodiment, the operating timing sequence of the pixel driving circuit further includes a non-light-emitting phase, in which the first transistor M1 operates in an off state.

The pixel driving circuit may include a phase without light emission, the light-emitting element D is controlled not to emit light, and a reset operation or the like can be performed during the light-emitting phase to avoid adverse effects of the reset operation or the like on light emission. The first transistor M1 can be turned off by controlling the voltage value of the control terminal VB of the first transistor M1. That is, by controlling the current not to flow into the light-emitting element D, the pixel driving circuit enters the non-light-emitting phase. In addition, by controlling the voltage value of the control terminal VB of the first transistor M1 so as to control the first transistor M1 to operate in the saturation state, the pixel driving circuit can be controlled to re-enter the light-emitting phase from the non-light-emitting phase, i.e., realizing light emission control using the first transistor M1. In this way, using a circuit that has a voltage holding function to realize the light emission control can also save costs and the occupied space.

Figure 3:
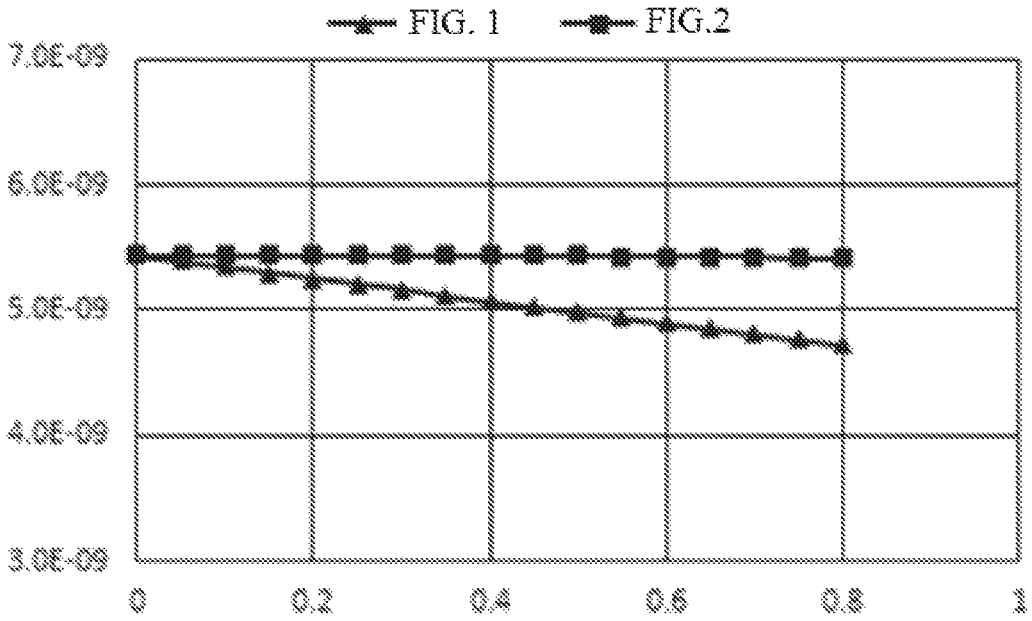
FIG. 3 is a simulation data diagram of the pixel driving circuit shown in FIGS. 1 and 2.

In addition, as shown in FIG. 3, FIG. 3 is a simulation data diagram of the pixel driving circuits shown in FIGS. 1 and 2. In FIG. 3, an abscissa represents the voltage across the two ends of the light-emitting element in the pixel driving circuit, with a unit V, and an ordinate represents the value of the current flowing through the light-emitting element in the pixel driving circuit, with a unit A. It can be seen that, in a case where other conditions are unchanged, as the voltage across the two ends of the light-emitting element changes, the value of the current flowing through the light-emitting element in the related art changes, resulting in a change in brightness, while in the embodiment of the present disclosure, as the voltage across the two ends of the light-emitting element changes, the current value flowing through the light-emitting element remains unchanged, i.e., the brightness remains unchanged.

An embodiment of the present disclosure further provides a display device including the pixel driving circuit described in any of the embodiments of the present disclosure.

The specific structure and principle of the pixel driving circuit are the same as those in the above embodiment and will not be repeated here. The display device may be any electronic device having a display function, such as a touch screen, a mobile phone, a tablet computer, a laptop, or a television.

The display device in the embodiment of the present disclosure can maintain the voltage of the node between the driving transistor and the light-emitting element unchanged during the light-emitting phase, so that the driving current generated by the driving transistor will not be affected by the change of the voltage across the two ends of the light-emitting element, thereby mitigating or eliminating the problem of uneven display due to the change in the voltage across the two ends of the light-emitting device.

In an embodiment, the display device is a silicon-based micro display device, a size of which is generally smaller than 1 inch, and a single pixel of which has an area of several square microns.

The above are only preferred embodiments of the present disclosure and are not intended to limit the present disclosure. Any modification, equivalent replacement, improvement, etc. made within the principle of the present disclosure should be included in the protection scope of the present disclosure.

Finally, it should be noted that the various embodiments above are only used to illustrate the technical solutions of the present disclosure rather than provide limitation thereto. Although the present disclosure has been described in detail with reference to the various embodiments above, those of ordinary skill in the art should understand that they can still modify the technical solutions described in the various embodiments above or equivalently replace some or all of the technical features without departing from the scope of the technical solutions of the various embodiments of the present disclosure.

What is claimed is:

1. A pixel driving circuit, comprising:

a driving transistor connected in series between a first power supply voltage terminal and a second power supply voltage terminal and having a control terminal electrically connected to a first node, a first terminal electrically connected to a second node, and a second terminal electrically connected to a third node, wherein the second node is located between the first power supply voltage terminal and the driving transistor, and the third node is located between the second power supply voltage terminal and the driving transistor;

a light-emitting diode connected in series between the third node and the second power supply voltage terminal; and a voltage maintaining circuit configured to maintain a voltage of the third node unchanged.

2. The pixel driving circuit according to claim 1, wherein the voltage maintaining circuit comprises:

a first transistor connected in series between the third node and the light-emitting element, wherein the first transistor is a P-type transistor and has a source electrode electrically connected to the third node and a drain electrode electrically connected to a fourth node, and the fourth node is electrically connected to the light-emitting element;

a first current sub-circuit electrically connected to the third node and configured to generate a first current flowing to the third node; and a second current sub-circuit electrically connected to the fourth node and configured to enable a second current to flow out of the fourth node, wherein a current value of the first current is equal to a current value of the second current.

3. The pixel driving circuit according to claim 2, wherein the first current sub-circuit comprises a second transistor, and the second transistor is a P-type transistor and has a source electrode electrically connected to a first fixed potential terminal and a drain electrode electrically connected to the third node; and the second current sub-circuit comprises a third transistor, and the third transistor is an N-type transistor and has a source electrode electrically connected to a second fixed potential terminal and a drain electrode electrically connected to the fourth node.

4. The pixel driving circuit according to claim 3, wherein the first fixed potential terminal is electrically connected to the first power supply voltage terminal, and the second fixed potential terminal is electrically connected to the second power supply voltage terminal.

5. The pixel driving circuit according to claim 1, further comprising:

a fourth transistor having a first terminal electrically connected to a data signal terminal and a second terminal electrically connected to the first node; and a capacitor having one terminal electrically connected to the first node.

6. The pixel driving circuit according to claim 1, wherein the driving transistor is a P-type transistor and operates in a sub-threshold state.

7. A pixel driving circuit, comprising:

a driving transistor connected in series between a first power supply voltage terminal and a second power supply voltage terminal and having a control terminal electrically connected to a first node, a first terminal electrically connected to a second node, and a second terminal electrically connected to a third node, wherein the second node is located between the first power supply voltage terminal and the driving transistor, and the third node is located between the second power supply voltage terminal and the driving transistor;

a light-emitting diode connected in series between the third node and the second power supply voltage terminal;

a first transistor connected in series between the third node and the light-emitting element, wherein the first transistor is a P-type transistor and has a source electrode electrically connected to the third node and a drain electrode electrically connected to a fourth node, the fourth node being electrically connected to the light-emitting element;

a second transistor, the second transistor being a P-type transistor and having a source electrode electrically connected to a first fixed potential terminal and a drain electrode electrically connected to the third node; and a third transistor, the third transistor being an N-type transistor and having a source electrode electrically connected to a second fixed potential terminal and a drain electrode electrically connected to the fourth node, wherein an operating timing sequence of the pixel driving circuit comprises a light-emitting phase in which each of the second transistor and the third transistor operates in a saturation region.

8. The pixel driving circuit according to claim 7, wherein the operating timing sequence of the pixel driving circuit further comprises a non-light-emitting phase in which the first transistor operates in an off state.

9. A display device, comprising the pixel driving circuit according to claim 1.

10. The display device according to claim 9, wherein the display device is a silicon-based micro display device.

* * * * *